United States Patent [19]

Edwards

[11] Patent Number: 4,483,102

[45] Date of Patent: Nov. 20, 1984

[54] REMOVABLE LOUVER COVERING SYSTEM

[76] Inventor: James D. Edwards, 9701 Nash La., Mablevale, Ark. 72103

[21] Appl. No.: 422,459

[22] Filed: Sep. 23, 1982

[51] Int. Cl.[3] ..... E06B 5/18

[52] U.S. Cl. ..... 49/465; 49/62; 49/67; 49/397

[58] Field of Search ..... 49/397, 51, 61, 62, 49/63, 67, 465, 484, 485, 489

[56] References Cited

U.S. PATENT DOCUMENTS

| | | | |
|---|---|---|---|
| 2,093,727 | 9/1937 | Julien | 49/67 X |
| 3,331,161 | 7/1967 | Ruff | 49/397 |
| 3,830,146 | 8/1974 | Kaiser | 49/67 X |
| 4,106,399 | 8/1978 | Lawrence, Jr. | 49/62 X |
| 4,272,934 | 6/1981 | Cowden et al. | 49/61 X |

*Primary Examiner*—Kenneth Downey
*Attorney, Agent, or Firm*—Stephen D. Carver

[57] ABSTRACT

A system of rigid, generally planar dimensions adapted to by removably, hingeably coupled to a conventional ventilator louver assembly to environmentally seal same to prevent energy losses. The louver covering system includes a rigid, generally rectangular frame formed of specially extruded members, which frame surroundably supports a rigid, generally planar insulating sheet. The frame includes front, side, and rear extrusion members which include integral bosses to aid in assembly. A separate, rigid, elongated extruded hanging rail having a hinge portion is adapted to be permanently coupled to the louver assembly. The system frame rear includes a cooperating hinge portion, which, when coupled to the aforementioned hanging rail hinge coupling extrusion enables the system to be hingeably swung to a closed position relative to the louver assembly. Latching means, preferably coupled to the louver assembly, may be manually twisted to engage flange portions of the frame to seal the louver. Frame channels support a plurality of insulating strips which form a surrounding seal which minimize air currents otherwise associated with conventional louver assemblies.

2 Claims, 8 Drawing Figures

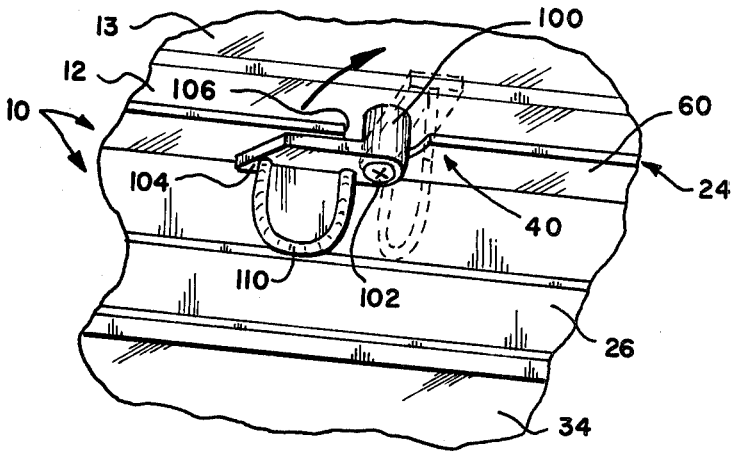
FIG. 3
FIG. 4
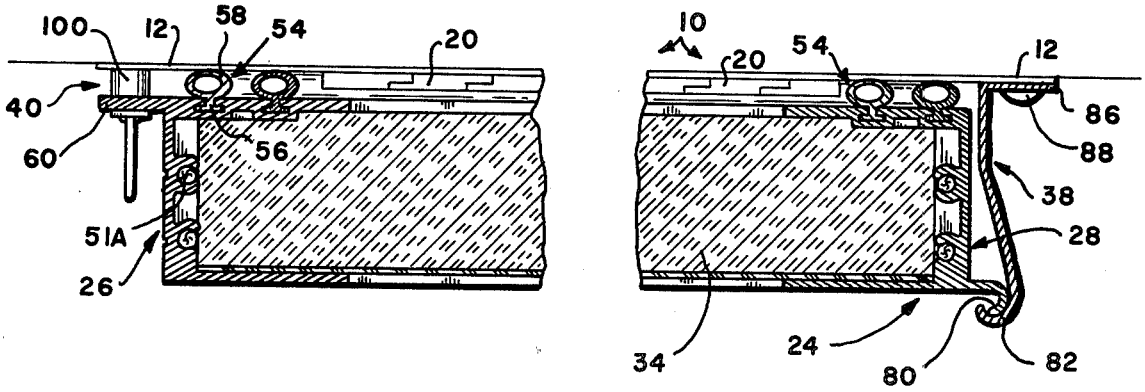
FIG. 5
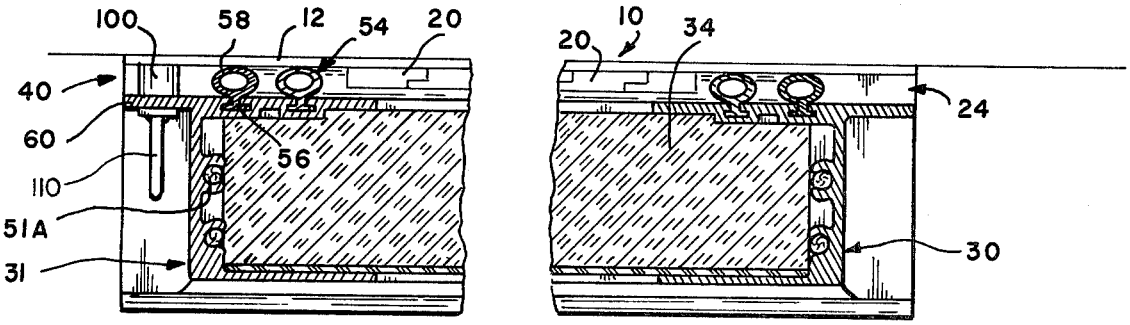

REMOVABLE LOUVER COVERING SYSTEM

BACKGROUND OF THE INVENTION

The present invention is concerned with a system for semi-permanently sealing louver assemblies. More particularly, the present invention is directed to an accessory louver covering system for enviromentally sealing "closed" louver covers typically associated with attic fans or the like.

In the prior art a plurality of various designs have been proposed for variably occluding the air passageways associated with attic fans and other conventional ventilating apparatus. For example, it is well known to provide a generally rectangular frame in which a plurality of rotatable louvers are disposed, the frame being mounted in the conduction pathway of an attic fan or the like. The various louver members of the system ideally are designed to provide a seal against air currents when the louver cover assembly is manipulated to the "closed" position. However, I have observed that significant air currents nevertheless pass through conventional louver assemblies, and the drafts associated with such phenomena are significant. Such a partially unblocked attic fan, for example, normally tends to rob the homeowner of heat energy during the winter months, in much the same way as an old fashioned fire place with an inefficient or unclosed damper.

Thus when the homeowner closes the conventional attic fan louver assembly, heat losses will nevertheless occur as air passes through the multiple open passageways. In the prior art it is known to provide some form of planar, rectangular covering which is permanently secured about the louvers. For example, it is known to bolt a generally rectangular covering securely about the edges of the louver assembly. Also, in the prior art it has been suggested merely to cover the louver assembly with some form of plastic and tape combination or the like.

As a practical matter it is very time consuming and annoying to the consumer to install or remove the aforedescribed "permanent" louver assembly coverings. On the other hand, where plastic or other coverings of sheet-like material are merely taped to the louver assembly, this presents an extremely unpleasant aesthetic appearance.

Therefore it is desireable to provide a rigid, aesthetically pleasing system which may quickly and easily be coupled to existing louver systems for semi-permanently blocking same. In other words, energy losses hitherto associated with "closed" ventilator louvers should be avoided with a semi-permanent, rigid sealing system which may be easily installed or removed as desired. Thus, for example, in the spring and fall seasons the prudent home owner may install or disengage the louver covering in response to radical fluctuations in outdoor temperature characteristic of the latter seasons to save energy.

SUMMARY OF THE INVENTION

The present invention comprises a rigid, generally rectangular, semi-permanently mounted louver covering system which, when installed by the homeowner, surrounds and seals conventional ventilator louver assemblies for minimizing energy losses typically associated therewith.

The invention contemplates a generally rectangular, planar insulating surface surrounded and supported between a plurality of rigid, extruded frame members. Each of the frame members are of generally C-shaped cross section, and include boss members to facilitate ease of assembly with conventional self tapping screws. The rear frame member includes a specially extruded, outwardly projecting lip member which functions as one part of a unique hinge. A cooperating extrusion member is permanently secured adjacent the louver assembly and it includes a downwardly projecting, inwardly turned cooperating lip which, in combination with the lip portion of the frame rear, completes the hinge assembly. Importantly, the latter extrusion member is in the form of a hanging rail which is permanently attached by the consumer adjacent the louver to be covered. The entire louver covering system is thus supported at the frame rear end by the aforementioned cooperating hinge system.

The tops of each of the frame extrusions are provided with suitable channels for locating insulation members. Latching means are contemplated whereby upper, outwardly projecting, integral flange portions of the front and side frame members may be manually latched to yieldably semi-permanently secure the covering system in position over the ventilating louver assembly.

Thus a broad object of the present invention is to provide an attic fan ventilator louver assembly with a cover assembly ideally adapted for semi-permanent mounting.

More particularly, it is an object of the present invention to greatly reduce energy losses ordinarily associated with conventional ventilator louver assemblies.

Another object of the present invention is to provide a ventilator louver assembly covering which may be quickly and easily removed or installed as desired by the homeowner.

A still further object of the present invention is to provide a ventilator louver assembly covering of the character described characterized by uniquely constructed frame extrusion members.

Yet another object of the present invention is to provide a unique hinge mounting system associated with a ventilator louver covering system of the character described which enables the installer to quickly and easily deploy the device with a minimum of tools, effort and time.

Yet another object of the present invention is to provide a rigid, insulative ventilator louver assembly covering system which may be quickly and inexpensivly installed by the homeowner, which, upon installation, will reliably seal the entire perimeter of the existing louver assembly.

Another object of the present invention is to provide an external energy saving covering for attic fan louver assemblies or the like which presents a pleasing aesthetic appearance.

Yet another object of the present invention is to provide a rigid, dependable and mechanically secure covering system which may be quickly detached or installed in firm, semipermanent position relative to a louver assembly.

A still further object of the present invention is to provide unique frame extrusion members for assembling an attic fan ventilator louver cover system of the character described.

A basic object of the present invention is to minimize heat losses associated with conventional attic fans.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therwith, and in which like reference numerals have been employed throughout to indicate like parts in the various views:

FIG. 3 is an enlarged, fragmentary pictorial view illustrating the latching means preferably employed for selectively closing the covering system;

FIG. 4 is an enlarged, fragmentary sectional view taken generally along line 4—4 of FIG. 1;

FIG. 5 is an enlarged, fragmentary sectional view taken generally along line 5—5 of FIG. 1;

DETAILED DESCRIPTION OF THE DRAWINGS

Figure 1:
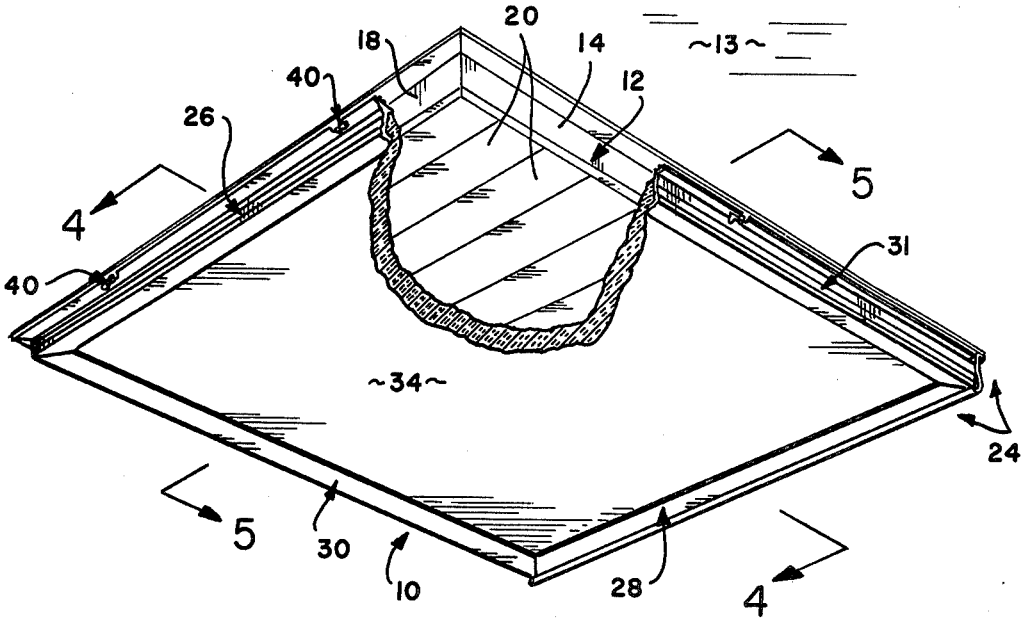
FIG. 1 is a fragmentary, isometric view illustrating my ventilator louver covering system semi-permanently installed upon a conventional ventilator louver system, with portions thereof shown in section for clarity.
Figure 2:
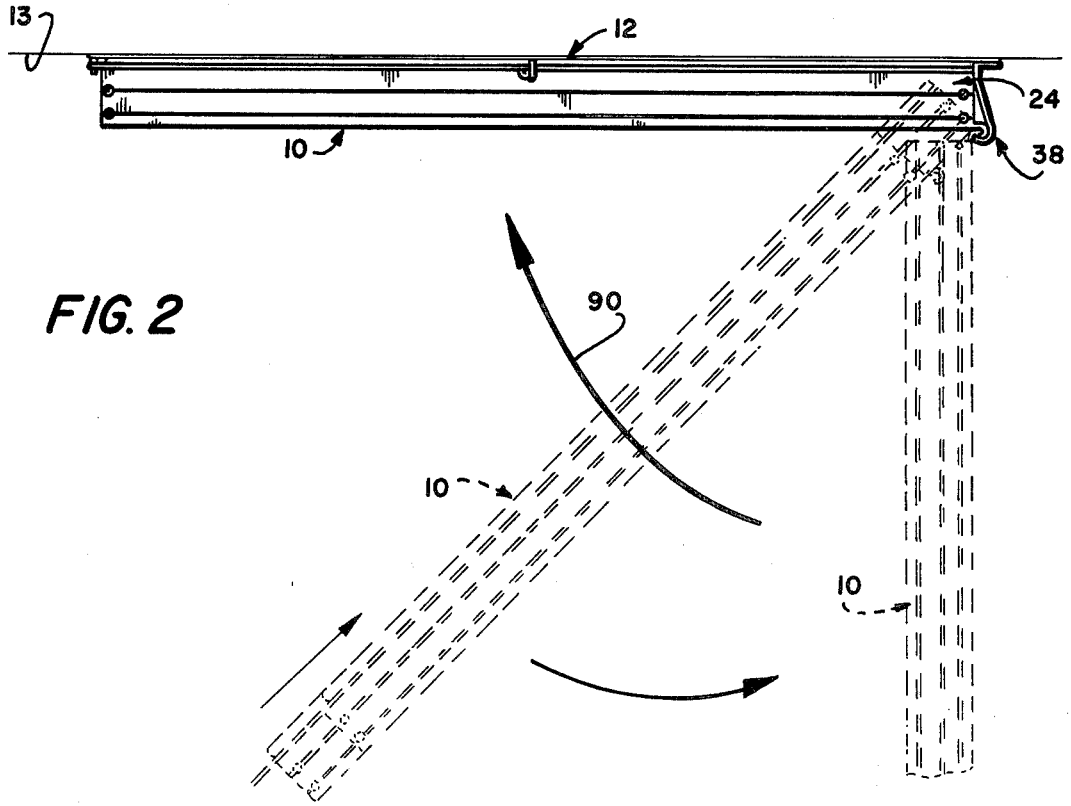
FIG. 2 is an enlarged side elevation view illustrating my removable louver covering system, with moved positions illustrated in dashed lines.

With initial reference now to FIGS. 1 and 2 of the appended drawings, a removable, louver covering system constructed in accordance with the preferred teachings of the present invention has been generally designated by the reference numeral 10. System 10 is adapted to seal or cover an existing, conventional attic fan ventilation louver assembly, generally designated by the reference numeral 12. It will be noted that such conventional assemblies are generally mounted upon a ceiling 13, or they may be associated with a conventional wall or the like.

The ventilator louver assembly 12 comprises a generally rectangular frame comprised of sides 14, and end 18 which project through and are associated with the ceiling (or wall) 13. As will be recognized by those skilled in the art, a plurality of flat louvers 20 extend between the sides 14 of the ventilator assembly 12. In FIG. 1 these louvers are indicated in the "closed" position; however, I have found that convection air currents easily pass between various unblocked passageways associated with conventional assemblies 12. The latter detriment is remedied with my system 10 to be hereinafter described in detail.

With additional reference now to FIGS. 3–5, my removable louver covering system 10 comprises a rigid, generally rectangular frame, generally designated by the reference numeral 24, comprised of a plurality of interconnected rigid extrusions. For example, frame 24 includes a front extrusion member, generally designated by the reference numeral 26, a rear extrusion member generally designated by the reference numeral 28, and side extrusion portions 30 and 31. Frame 24 is thus of generally rectangular dimensions, and it secures a generally planar, rectangular sheet of insulating material, generally designated by the reference numeral 34, in sealed, spaced apart relation with respect to the closed louvers 20.

While the system 10 is adapted to be quickly detached from engagement with respect to the louver assembly 12, a hanging rail comprising a generally L-shaped extrusion member, generally designated by the reference numeral 38, is permanently affixed to the louver assembly 12. As will be described in more detail hereinafter, this L-shaped extrusion 38 cooperates with the rear frame extrusion 28 to form a hinge, such that the louver covering 10 may be moved between the open and closed positions illustrated generally in FIG. 2. When moved to the closed position, latching means, generally designated by the reference numeral 40 (FIG. 3), may secure the apparatus in the semi-permanent "closed" position. It is to be understood that the hanging rail 38 will be permanently attached to ceiling 13 so that frame 24 may be selectively coupled to it to block louver passageways 20.

Figure 8:
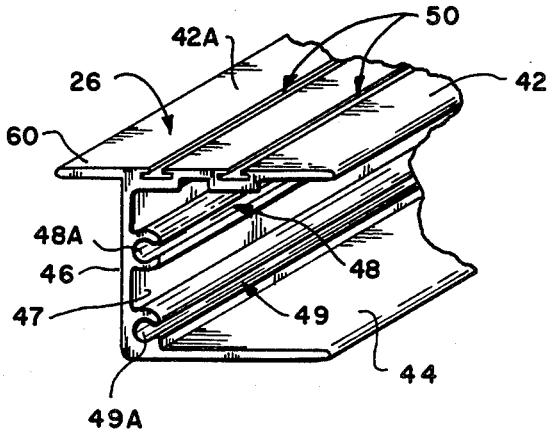
FIG. 8 is an enlarged, fragmentary isometric view illustrating the preferred construction of the frame front and side extrusion members.

The front portion 26, and sides 31 and 30 of frame 24 are preferably of identical geometry. With this in mind, attention is now directed to FIG. 8. Front extrusion 26, for example, is of generally C-shaped cross section, including a rigid, generally planar top portion 42 spaced apart from an integral, generally parallel bottom 44. Top 42 is integrally connected to bottom 44 with a generally perpendicularly oriented rigid side 46. A pair of internal, generally tubular bosses 48, 49 project inwardly from inner wall 47 of side portion 46. The terminal orifices 48A, 49A of these boss extrusions are suitable for receiving conventional self-tapping screws 51A (FIGS. 4, 5) to facilitate assembly of adjoining mitered frame members. As will be appreciated by those skilled in the art, assembly requires suitable angled mitering, followed by the drilling of suitable screw holes in proper operative locations. As also viewed in FIG. 8, it will be apparent that a pair of elongated, parallel, spaced-apart channel members, generally designated by the reference numeral 50, are defined along the upper surface 42A of top 42. These channels are adapted to receive conventional insulating strips, generally designated by the reference numeral 54 (FIGS. 4 and 5). It will be apparent that these insulating members include a generally planar strip-like bottom 56 integral with an upper, generally tubular body portion 58 which, when compressed against the louver assembly (as illustrated in FIGS. 4 and 5) provides an air-tight seal to reduce energy losses.

The frame front extrusion 26 and sides 30, 31 thereof, also include an outwardly projecting, integral upper flange portion 60 associated with the top 42. This flange portion may engage the latching means 40 (FIG. 3) to secure apparatus 10 as will hereinafter be described.

Figure 7:
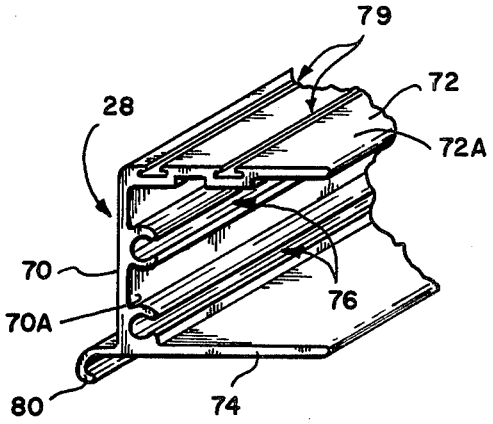
FIG. 7 is an enlarged, fragmentary isometric view illustrating the frames rear extrusion member.

With reference now to FIGS. 4 and 7, the rear frame extrusion 28 comprises an outer side 70 extending between rigid, generally planar top 72 spaced apart from lower, generally planar and parallel bottom 74. As in the case of the side or front extrusion members (FIG. 8) internal assembly boss passageways, generally designated by the reference numeral 76, are defined interiorly of the frame extrusion 28, defined upon inner surface wall 70A. Also, a pair of spaced apart, parallel channel members, generally designated by the reference numeral 79, are formed in the upper surface 72A of top 72. These channels 79 receive sealing insulation members 54 (FIG. 4) along the lines previously discussed.

Figure 6:
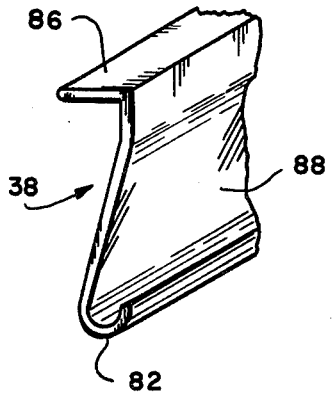
FIG. 6 is an enlarged, fragmentary isometric view of a portion of the L-shaped extrusion member adapted to be permanently mounted to the louver cover assembly.

Importantly, a lower, outwardly and downwardly projecting arcuate lip portion 80 is integral with frame extrusion 28. The arcuate hinge lip 80 of frame rear extrusion 28 is adapted to be received by similar arcuate lip member 82 forming the bottom of hanging rail extrusion 38 (FIGS. 4, 6). The generally L-shaped extrusion 38 includes a generally planar top 86 adapted to be secured in permanent relation upon a portion of the attic ventilator louver assembly (or ceiling, wall or the like) by a plurality of conventional sheet metal screws 88 (FIG. 4). Hanging rail member 38 includes a generally vertically oriented body portion 88 which terminates at its bottom in the arcuate lip 82 which cooperates with frame lip member 80 (FIG. 7) to form a quickly detachable or semi-permanent hinge assembly. Thus, once the rear frame lip 80 is appropriately positioned within cooperating hinge lip member 82, the entire apparatus 10 may be manually rotated to the closed position, in the general direction of the arrow 90 (FIG. 2).

As will be appreciated by inspection of the structure, once the louver cover apparatus 10 is manually moved into the "closed" position, it may be mechanically secured through a variety of different approaches. However, I have found it preferable to mount the system 10 with the apparatus 40 shown in FIG. 3.

Latching system 40 preferably includes a generally cylindrical, rigid standoff 100 permanently secured to the louver assembly 12 by a conventional screw 102, which also secures a pivotally displaceable bracket 104. Standoff 100 penetrates a suitable notch 106 defined in an appropriate interval within the flange portion 60 of the frame extrusions 26, 30 or 31. A generally arcuate, rigid handle 110 projecting perpendicularly away from latch 104 aids in manipulation between the closed position (illustrated in solid lines in FIG. 3) and the removing position, illustrated in dashed lines therein. In other words, with reference to FIG. 3, it will be apparent that when the operator manually grasps handle 110 and moves it to the position illustrated in dashed lines, latching portion 104 will no longer contact the outwardly projecting flange 60 associated with frame 24, so that the entire cover assembly 10 may drop downwardly into the position illustrated in dashed lines of FIG. 2. It should also be appreciated that the number and positions of the latching systems is a matter of design choice. In other words, in the preferred mode it is contemplated to provide a latching system 40 at a pair of locations relative to frame front 26, and I have found it preferable to also include a latching assembly associated with each of the side frame extrusions 30, 31.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A removable energy saving covering system for selectively sealing conventional ventilation louver assemblies, the system comprising:

a generally planar louver covering member adapted to be removably secured in generally horizontally oriented parallel relation with respect to a ventilation louver to be sealed, the covering member comprising a rigid, generally rectangular frame comprising:

a rigid, elongated front extrusion member and a pair of parallel, spaced apart, elongated, rigid side extrusion members projecting perpendicularly from and coupled to said front extrusion member at opposite ends thereof;

a rear, elongated, rigid extrusion member rigidly coupled between said side extrusion members in spaced-apart, parallel relation with respect to said front extrusion member and including an integral outwardly projecting, bottom arcuate lip member;

a generally planar, rectangular sheet of insulating material secured by and enclosed between said frame extrusion members;

said frame front, rear and side extrusion members being generally of C-shaped cross section and including:

a rigid, generally planar top portion including channel means defined therein for mounting insulation strips adapted to form a seal around the periphery of said louver assembly;

an integral, rigid side portion including inwardly extending, integral boss means for facilitating assembly of said frame;

a lower, generally integral planar bottom generally parallel to said top and, in cooperation with said top, operative to to sandwich the edges of said sheet of insulating material therebetween; and, said front and side frame extrusion members including an integrally outwardly extending generally planar, peripheral flange;

a rigid, generally L-shaped, elongated extruded hanging rail adapted to be permanently mounted adjacent said louver, said rail including a lower, arcuate lip portion adapted to be coupled to said rear frame member extrusion lip for hingeably mounting said covering member over said louver assembly; and, latch means for selectively securing said covering member in a closed, generally horizontal sealing position relative to said louver assembly.

2. The combination as defined in claim 1 wherein said latch means is permanently coupled to a portion of said ventilation louver assembly and operative to engage at least a portion of the frame flange portion to operatively secure the system.

* * * * *